US008464673B2

(12) United States Patent
Kong et al.

(10) Patent No.: US 8,464,673 B2
(45) Date of Patent: Jun. 18, 2013

(54) VARIABLE VALVE LIFT APPARATUS

(75) Inventors: Jin Kook Kong, Suwan (KR); Soo Hyung Woo, Yongin (KR)

(73) Assignee: Hyundai Motor Company, Seoul (KR)

( * ) Notice: Subject to any disclaimer, the term of this patent is extended or adjusted under 35 U.S.C. 154(b) by 301 days.

(21) Appl. No.: 12/952,727

(22) Filed: Nov. 23, 2010

(65) Prior Publication Data

US 2011/0315105 A1 Dec. 29, 2011

(30) Foreign Application Priority Data

Jun. 25, 2010 (KR) ..... 10-2010-0060765

(51) Int. Cl.
*F01L 1/34* (2006.01)

(52) U.S. Cl.
USPC ..... 123/90.16; 123/90.15; 123/90.18

(58) Field of Classification Search
USPC ..... 123/90.15, 90.16, 90.18
See application file for complete search history.

(56) References Cited

U.S. PATENT DOCUMENTS 5,505,168 A * 4/1996 Nagai et al. ..... 123/90.17

FOREIGN PATENT DOCUMENTS

JP 52-044314 4/1977
JP 59-126107 U 8/1984

* cited by examiner

*Primary Examiner* — Zelalem Eshete
(74) *Attorney, Agent, or Firm* — Morgan, Lewis & Bockius LLP

(57) ABSTRACT

A variable valve lift apparatus may include a control shaft slidably disposed within a camshaft, a cam which is slidably disposed to the camshaft and a high lift cam lobe and a low lift cam lobe is formed thereto, a valve opening/closing unit contacting the cam and a control portion which moves the cam for the high lift cam lobe or the low lift cam lobe selectively to contact the valve opening/closing unit according to operation of the control shaft.

13 Claims, 11 Drawing Sheets

VARIABLE VALVE LIFT APPARATUS

CROSS-REFERENCE TO RELATED APPLICATION

The present application claims priority to Korean Patent Application No. 10-2010-0060765 filed on Jun. 25, 2010, the entire contents of which is incorporated herein for all purposes by this reference.

BACKGROUND OF THE INVENTION

1. Field of the Invention

The present invention relates to a variable valve lift apparatus. More particularly, the present invention relates to a variable valve lift apparatus which have a control portion for controlling valve lift within a camshaft.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches has been undertaken. For example, research has been undertaken for a variable tappet that enables different lifts depending on an engine speed.

However, a conventional variable valve lift apparatus needs a space for a control portion for controlling valve lift, so that entire volume of an engine has to be increased.

And also, if a manufacturing line using a general valve lift apparatus is changed to a manufacturing line using a conventional variable valve lift apparatus, a valve train has to be changed so that production cost is increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable valve lift apparatus having advantages of preventing an engine from increasing volume of an engine by providing a control portion for controlling valve lift within a camshaft.

According to various aspects of the present invention, valve train does not need to be changed so that increasing of production cost may be prevented.

In an aspect of the present invention, the variable valve lift apparatus may include a control shaft slidably disposed within a camshaft, a cam which may be slidably disposed to the camshaft and a high lift cam lobe and a low lift cam lobe may be formed thereto, a valve opening/closing unit slidably contacting the cam, and a control portion which moves the cam for the high lift cam lobe or the low lift cam lobe selectively to contact the valve opening/closing unit according to operation of the control shaft.

The control portion may include a shift lever which may be slidably mounted to the control shaft, wherein a high lift path and a low lift path may be formed along an outer surface of the shift lever, and a partition may be formed therebetween, and a control pin which protrudes from an inner surface of the camshaft, and selectively rotates along the high lift path and the low lift path, wherein a connecting penetration may be formed to the partition for the control pin to be movable between the high lift path and the low lift path, wherein the control portion further may include a control ring fixed to the control shaft, a rotation ring which may be slidably and rotatably mounted to the control shaft and rotates with the camshaft, wherein a cam connecting pin connects the cam with the rotation ring, and an elastic member disposed between the control ring and the rotation ring.

The control portion may include a control ring fixed to the control shaft, a shift lever slidably mounted to the control shaft, wherein a high lift path and a low lift path may be formed thereto and divided by a partition therebetween and a connecting penetration may be formed to the partition, wherein the shift lever may be movable in a length direction of the control shaft according to movement of the control ring, a control pin which protrudes from an inner surface of the camshaft, and selectively rotates along the high lift path and the low lift path according to movement of the shift lever, a rotation ring which may be slidably and rotatably mounted to the control shaft, wherein a cam connecting pin connects the cam and the rotating ring such that the rotation ring rotates with the camshaft, and an elastic member disposed between the control ring and the rotation ring, wherein the rotation ring may be disposed to an end of the shift lever, the control ring may be disposed as a pair, and the shift lever and the rotation ring may be disposed between the control ring, and the elastic member may be disposed between the rotation ring and the control ring.

A camshaft guide slot may be formed to the camshaft and receives the cam connecting pin therein for the cam connecting pin to be movable in the length direction of the camshaft.

The control portion further may include an elastic member supporting ring disposed between the elastic member and the rotation ring.

The camshaft and the cam may be splined for the cam to be movable in the length direction of the control shaft.

In another aspect of the present invention, the control portion may include a shift lever which may be slidably mounted to the control shaft, wherein a high lift path and a low lift path may be formed to the shift lever and divided by a partition therebetween and a connecting penetration may be formed to the partition, wherein a shift lever guide slot may be formed to the shift lever in a length direction thereof, and wherein a cam connecting pin guide portion may be formed along an outer circumference of the shift lever, a control pin which protrudes from an inner surface of the camshaft, and selectively rotates along the high lift path and the low lift path, a control ring which may be disposed to the shift lever and slidable within a predetermined distance, and connected to the control shaft through the shift lever guide slot, and a cam connecting pin connected to the cam and rotating along the cam connecting pin guide portion, wherein the shift lever may be movable in the length direction of the control shaft by movement of the control ring, wherein a plurality of cam connecting pin guide portion may be formed to the shift lever, the control ring may be disposed between the cam connecting pin guide portions, and an elastic member may be disposed between the control ring and the cam connecting pin guide portion.

The variable valve lift apparatus further may include an end ring which may be disposed at an end of the shift lever, and a cam connecting pin guide portion may be formed thereto, wherein the control ring may be disposed between cam connecting pin guide portions formed to the end ring and the shift lever, and an elastic member may be disposed between the each cam connecting pin guide portion and the control ring.

A limiting ring for limiting movement of the shift lever may be formed to the control shaft near to the shift lever.

A camshaft guide slot may be formed to the camshaft to receive the cam connecting pin for the cam connecting pin to be movable in the length direction of the camshaft.

The camshaft and the cam may be splined for the cam to be movable in the length direction of the control shaft.

As described above, the variable valve lift apparatus according to exemplary embodiments of the present invention may be provided with a control portion for controlling valve lift within a camshaft so that increasing volume of an engine may be prevented.

Also, the variable valve lift apparatus according to exemplary embodiments of the present invention may not need to change prior valve train so that manufacturing cost may be reduced.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
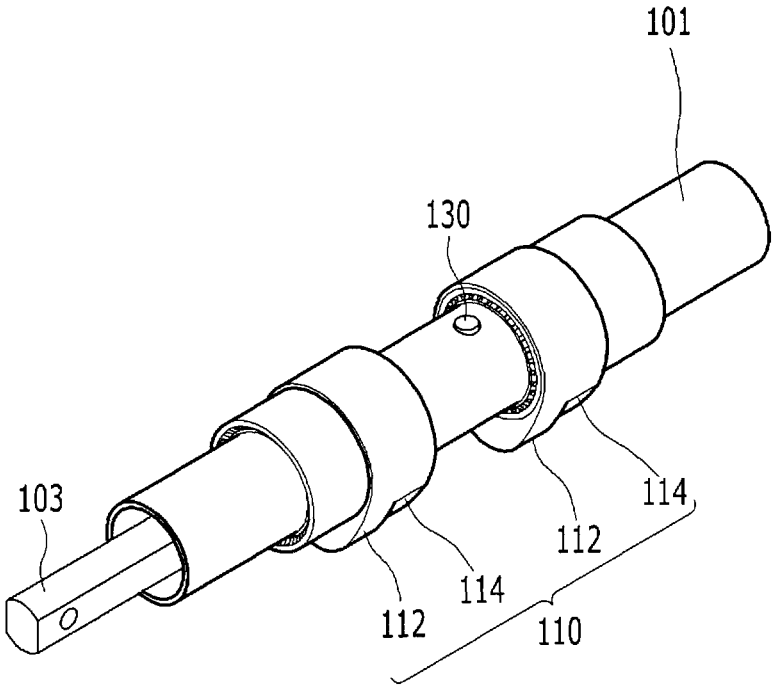
FIG. 1 is a perspective view of a variable valve lift apparatus according to the various exemplary embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will hereinafter be described in detail with reference to the accompanying drawings.

Figure 2:
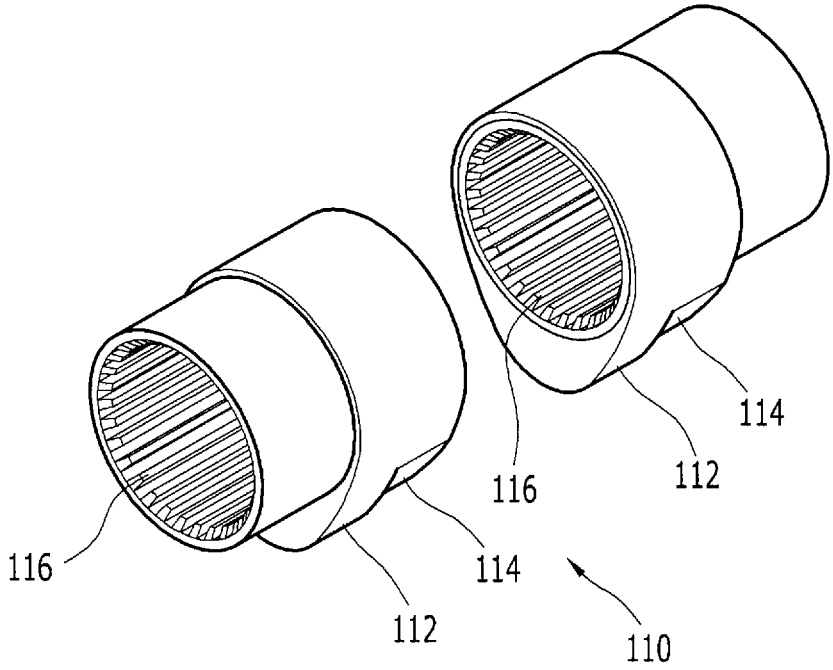
FIG. 2 is a perspective view of a cam of the variable valve lift apparatus according to the various exemplary embodiments of the present invention.

FIG. 1 is a perspective view of a variable valve lift apparatus according to the first exemplary embodiment of the present invention and FIG. 2 is a perspective view of a cam of the variable valve lift apparatus according to the first exemplary embodiment of the present invention.

Figure 3:
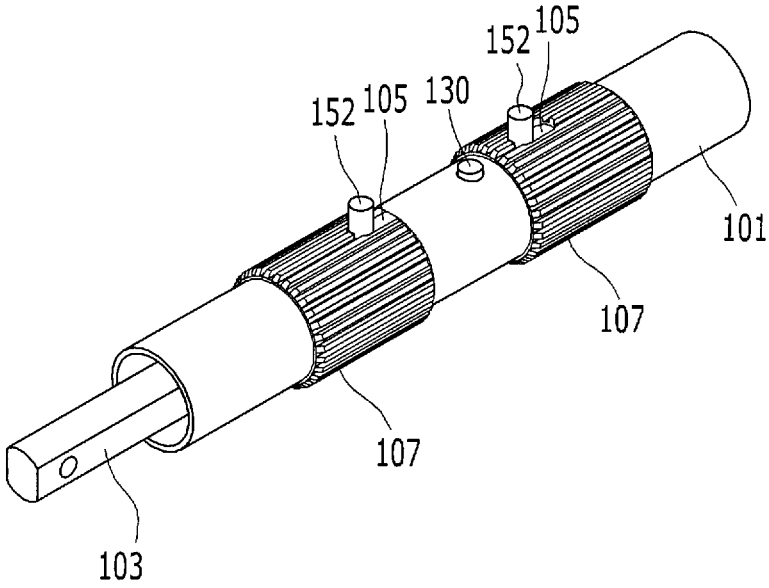
FIG. 3 and FIG. 4 is a perspective view of partial elements of the variable valve lift apparatus according to the various exemplary embodiments of the present invention respectively.
Figure 4:
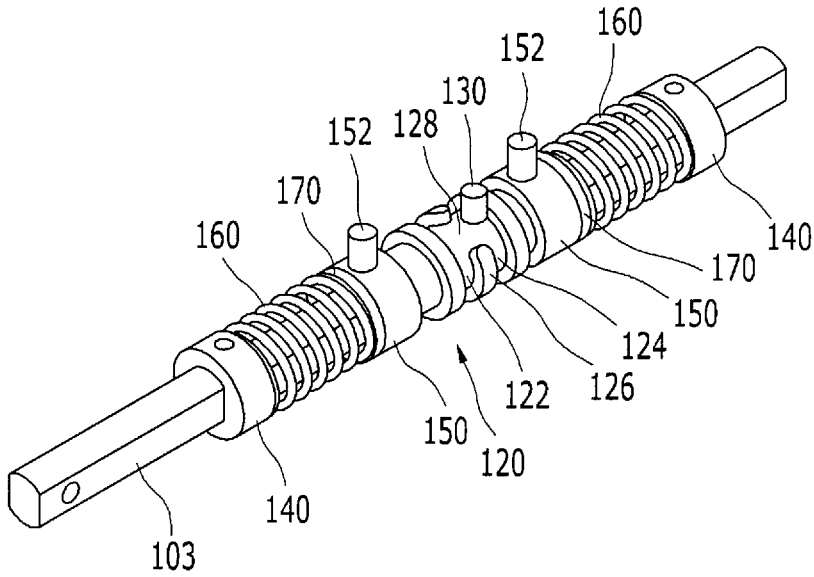

FIG. 3 and FIG. 4 is a perspective view of partial elements of the variable valve lift apparatus according to the first exemplary embodiment of the present invention respectively.

Figure 5:
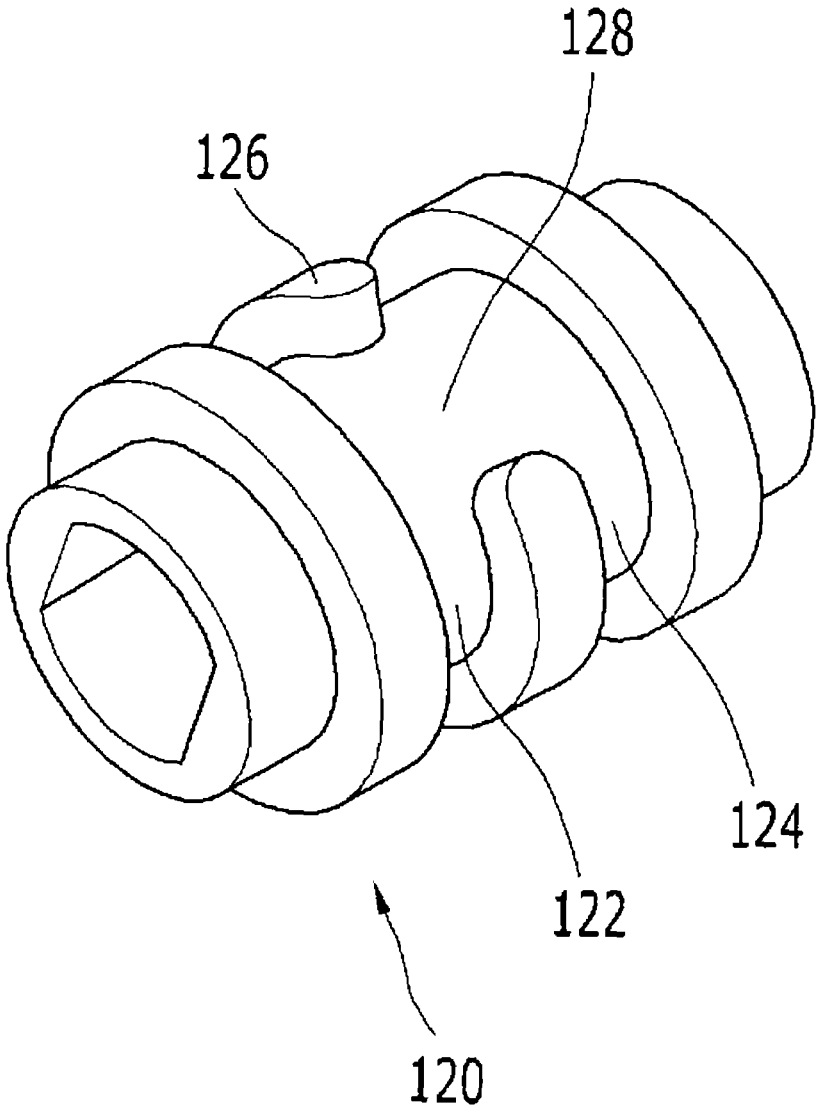
FIG. 5 is a perspective view of a shift lever of the variable valve lift apparatus according to the various exemplary embodiments of the present invention.
Figure 6:
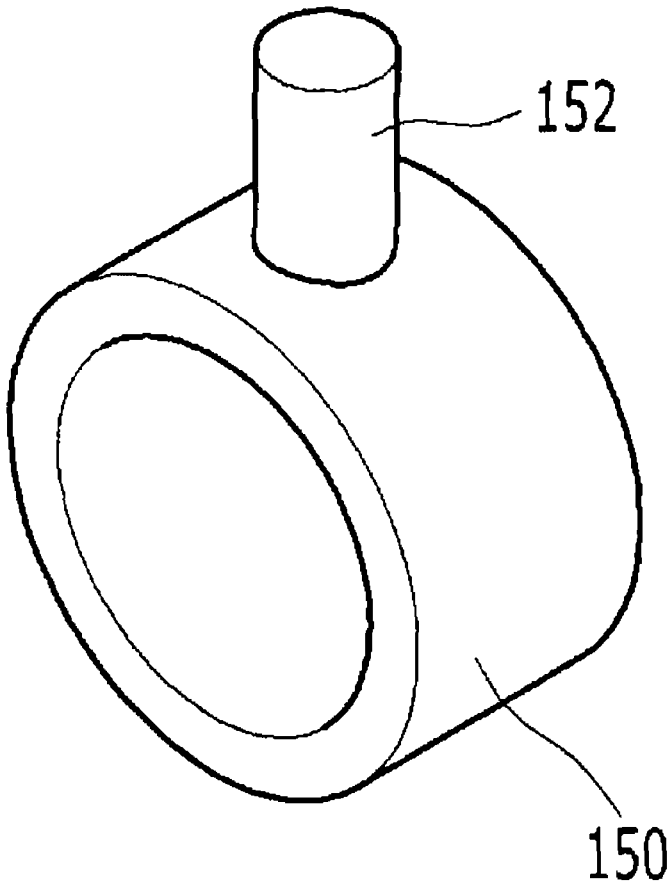
FIG. 6 is a perspective view of a rotation ring of the variable valve lift apparatus according to the various exemplary embodiments of the present invention.

FIG. 5 is a perspective view of a shift lever of the variable valve lift apparatus according to the first exemplary embodiment of the present invention and FIG. 6 is a perspective view of a rotation ring of the variable valve lift apparatus according to the first exemplary embodiment of the present invention.

Referring to FIG. 1 to FIG. 6, a variable valve lift apparatus according to the first exemplary embodiment of the present invention includes a control shaft 103 slidably disposed within a camshaft 101, a cam 110 which is slidably disposed to the camshaft 101 and a high lift cam lobe 112 and a low lift cam lobe 114 are formed thereto, a valve opening/closing unit contacting the cam 110 and a control portion which moves the cam 110 for the high lift cam lobe 112 or the low lift cam lobe 114 selectively to contact the valve opening/closing unit according to operation of the control shaft 103.

Figure 7:
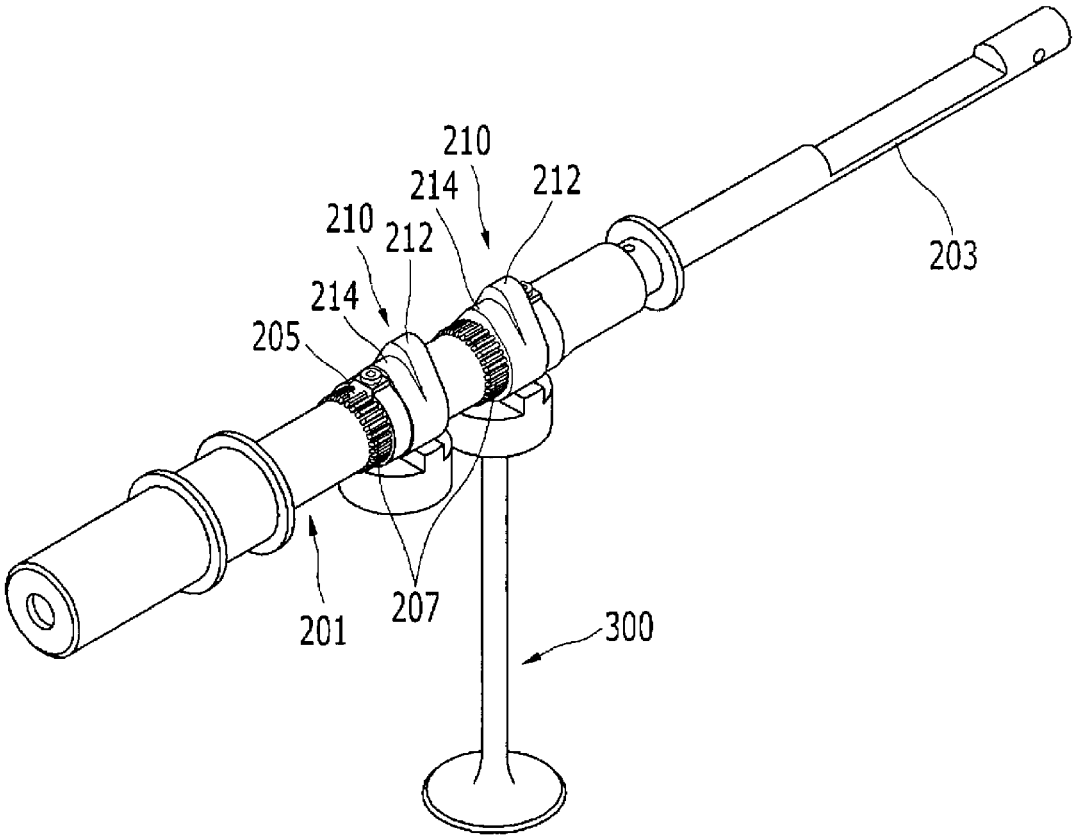
FIG. 7 is a perspective view of a variable valve lift apparatus according to the various exemplary embodiments of the present invention.

The valve opening/closing unit may be referred as a reference number 300 in FIG. 7.

The control portion includes a shift lever 120 and a control pin 130 fixed to the cam shaft 101 and protruding inwards.

The shift lever 120, referring to FIG. 5 and FIG. 6, is slidably disposed to the control shaft 103, a high lift path 122 and a low lift path 124 are formed along surface of the shift lever 120, and a partition 126 is formed thereto between the high lift path 122 and the low lift path 124.

The control pin 130 is protrudedly formed inside of the camshaft 101, and rotates along the high lift path 122 and the low lift path 124.

A connecting penetration 128 is formed to the partition 126 for the control pin 130 to be movable between the high lift path 1122 and the low lift path 124.

The control portion may further include a control ring 140 connected to the control shaft 104, a rotation ring 150 which is slidably disposed to the control shaft 103, rotates with the camshaft 101, and is provided with a cam connecting pin 152 connected with the cam 110 and an elastic member 160 disposed between the control ring 140 and the rotation ring 150.

The rotation ring 150 is disposed to each end of the shift lever 120, the control ring 140 is disposed as a pair and the shift lever 120 and the rotation ring 150 are disposed between the control rings 140, and the elastic member 160 is disposed between the rotation ring 150 and the control ring 140.

A camshaft guide slot 105 is formed to the camshaft 101 for the cam connecting pin 152 movable along length direction of the camshaft 101.

The control portion further includes an elastic member supporting ring 170 disposed between the elastic member 160 and the rotation ring 150.

A camshaft spline 107 and a cam spline 116 are respectively formed to the camshaft 101 and the cam 110, and thus, the camshaft 101 and the cam 110 are splined for the cam 110 movable to length direction of the control shaft 103.

Hereinafter, referring to the drawings, operations of the variable valve lift apparatus according to the first exemplary embodiment of the present invention will be explained.

Low lift mode of the variable valve lift apparatus are shown in FIG. 1 to FIG. 4.

In the low lift mode, the control pin 130 rotates along the low lift path 124 of the shift lever 120 and the low lift cam lobe 114 of the cam 110 contacts the valve opening/closing unit (referring to reference number 300 in FIG. 7) and opens and closes the valve opening/closing unit.

If changing of mode from low lift mode to high lift mode is required according to engine operation condition, an ECU (engine control unit, not shown) operates an actuator, a step motor and so on, for the control shaft 103 to move to right direction of the drawing.

In this case, operations and scheme of the ECU, the actuator and so on are not essential points of the present invention, so that detailed explanation will be omitted.

And then, the control ring 140 connected to the control shaft 103 moves toward right direction of the drawing with the control shaft 103.

Also, the shift lever 120 is moved toward right direction of the drawing by elastic force of the elastic member 160 contacting the control ring 140.

In the shift lever 120, the control pin 130 passes through the connecting penetration 128 and rotates along the high lift path 122.

And then, the rotation ring 150 moves toward right direction of the drawing, and also the cam 110 moves toward right direction to the camshaft 101.

And thus, the valve opening/closing unit contacts to the high lift cam lobe 112 and is opened and closed.

If changing of mode from the high lift mode to the low lift mode is required according to engine operation condition, the control shaft 103 to move to left direction of the drawing, and the control ring 140 connected to the control shaft 103 moves toward left direction of the drawing with the control shaft 103.

Also, the shift lever 120 is moved toward left direction of the drawing by elastic force of the elastic member 160 contacting the control ring 140 and the control pin 130 passes through the connecting penetration 128 and rotates along the low lift path 124.

And then, the rotation ring 150 moves toward left direction of the drawing, and also the cam 110 moves toward left direction to the camshaft 101.

And thus, the valve opening/closing unit contacts to the low lift cam lobe 114 and is opened and closed.

In the FIG. 4, while the elastic portions 160 as a pair are disposed both side of the shift lever 120, it is not limited to the drawing. One elastic member may be provided for supplying compress/expansion elastic force.

Figure 8:
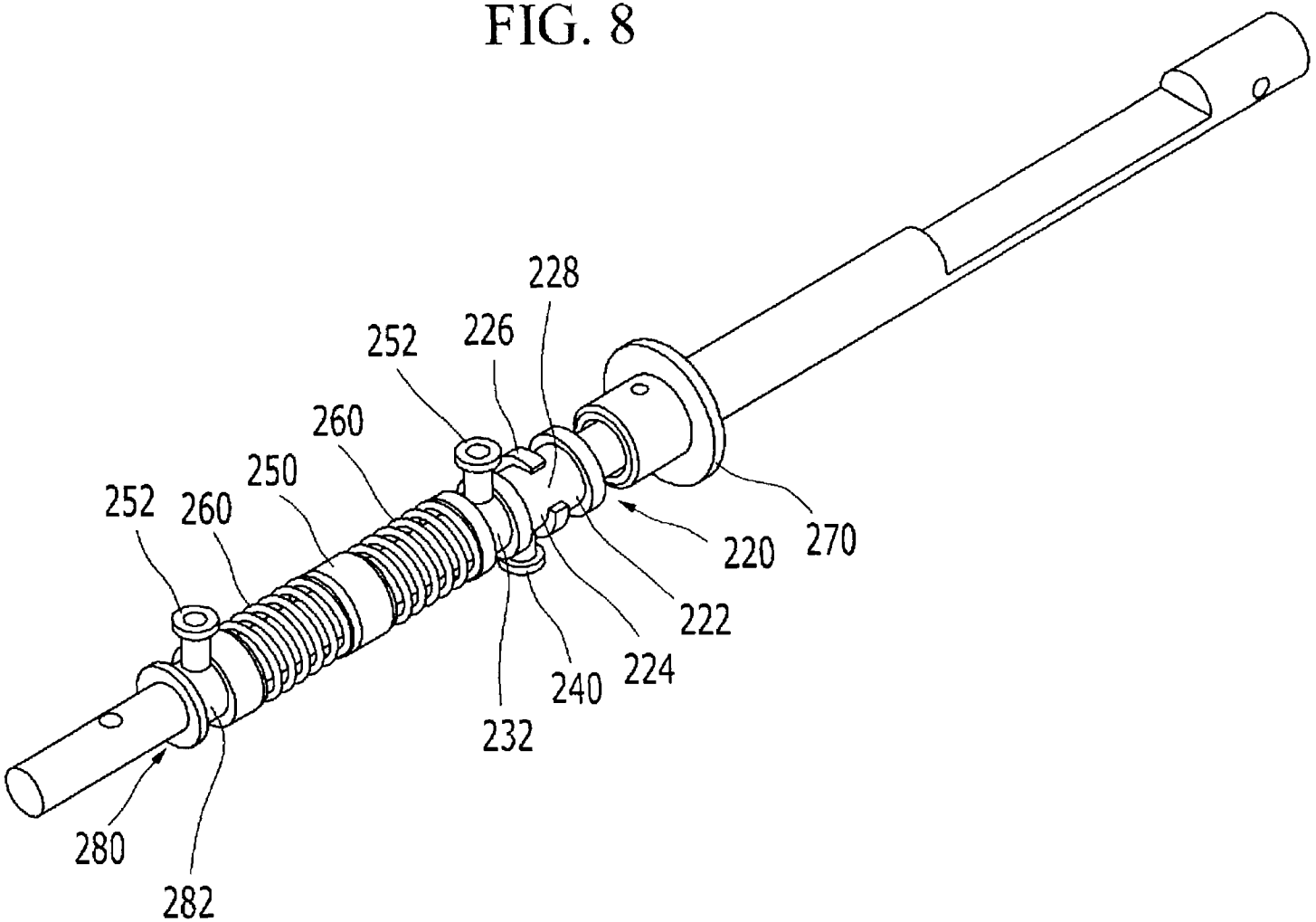
FIG. 8 is a perspective view of partial elements of the variable valve lift apparatus according to the various exemplary embodiments of the present invention.

FIG. 7 is a perspective view of a variable valve lift apparatus according to the second exemplary embodiment of the present invention and FIG. 8 is a perspective view of partial elements of the variable valve lift apparatus according to the second exemplary embodiment of the present invention.

Figure 9:
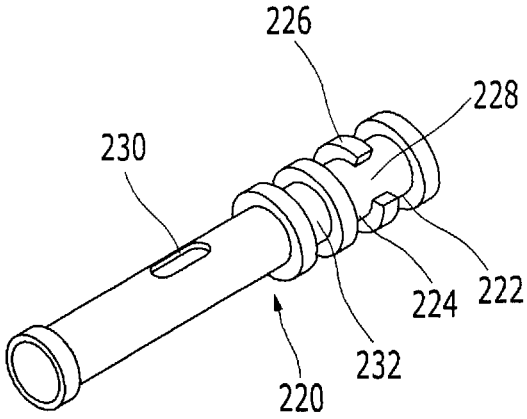
FIG. 9 is a perspective view of a shift lever of the variable valve lift apparatus according to the various exemplary embodiments of the present invention.
Figure 10:
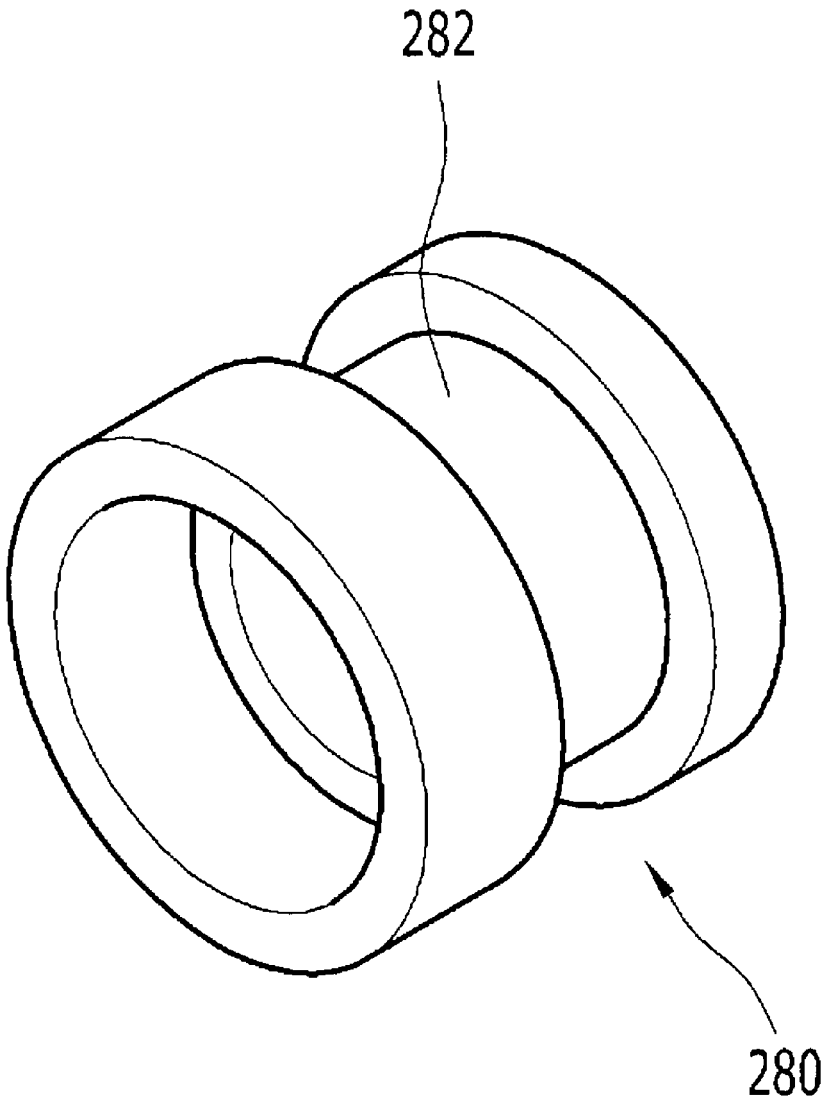
FIG. 10 is a perspective view of an end ring of the variable valve lift apparatus according to the various exemplary embodiments of the present invention.

FIG. 9 is a perspective view of a shift lever of the variable valve lift apparatus according to the second exemplary embodiment of the present invention and FIG. 10 is a perspective view of an end ring of the variable valve lift apparatus according to the second exemplary embodiment of the present invention.

Figure 11:
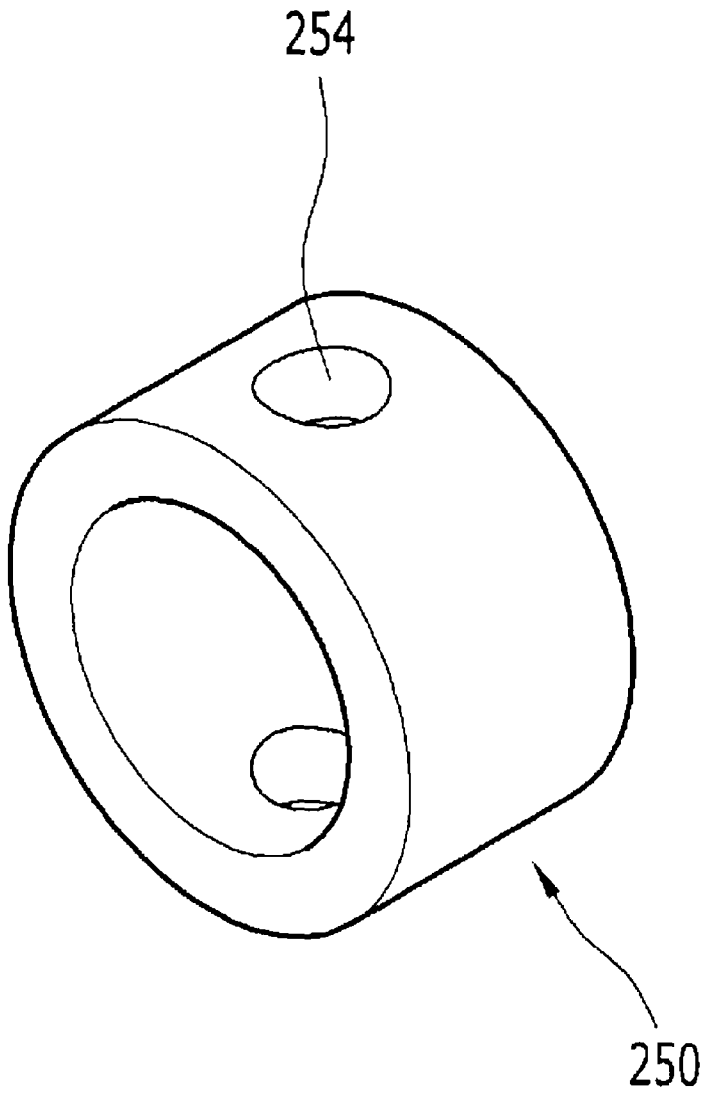
FIG. 11 is a perspective view of a control ring of the variable valve lift apparatus according to the various exemplary embodiments of the present invention.

FIG. 11 is a perspective view of a control ring of the variable valve lift apparatus according to the second exemplary embodiment of the present invention.

Repeated explanation of the same scheme of a variable valve lift apparatus according to the second exemplary embodiment of the present invention as the first exemplary embodiment of the present invention will be omitted.

Referring to FIG. 7 to FIG. 11, in a variable valve lift apparatus according to the second exemplary embodiment of the present invention, the control portion includes a shift lever 220, a control pin 240, a control ring 250 and a cam connecting pin 252.

The shift lever 220 is slidably disposed to the control shaft 203, a high lift path 222 and a low lift path 224 are dividedly formed by a partition 226, and a connecting penetration 228 is formed to the partition 226. And a shift lever guide slot 230 is formed along the length direction of the shift lever 220, and a cam connecting pin guide portion 232 is formed along circumference direction of the shift lever 220.

The control pin 240 is protrudedly formed inside of the camshaft 201, and rotates along the high lift path 222 and the low lift path 224.

The control ring 250 is slidably disposed to the shift lever 220 and connected to the control shaft 203 through the shift lever guide slot 230. The control ring 250, as shown in FIG. 11, may be connected to the control shaft 203 through a hole 254 with a pin.

The cam connecting pin 252 rotates along the cam connecting pin guide portion 232 and is connected with the cam 210.

The camshaft 201 is provided with the cam 210, a high lift cam lobe 212 and low lift cam lobe 214 is formed to the cam 210, and a valve opening/closing unit 300 selectively contacts the high lift cam lobe 212 or the low lift cam lobe 214.

The shift lever 220 may be moved along length direction of the control shaft 203 according to movement of the control ring 250.

A plurality of cam connecting pin guide portion 232 and 282 is formed to the shift lever 220, the control ring 250 is disposed between the cam connecting pin guide portion 232 and 282, and an elastic member 260 is disposed between the control ring 250 and the cam connecting pin guide portion 232 and 282.

A plurality of cam connecting pin guide portion 232 and 282 may be formed to the shift lever 220 and as shown in FIG. 9 and FIG. 10, the shift lever 220 and an end ring 280 may be formed separately and a plurality of cam connecting pin guide portion 232 and 282 may be formed respectively.

That is, the variable valve lift apparatus may further include the end ring 280, provided with the cam connecting pin guide portion 282, formed an end of the shift lever 220, the control ring 250 is disposed between the cam connecting pin guide portion 232 and 282, formed to the end ring 280 and the shift lever 220 respectively, and the elastic member 260 may be disposed between the each cam connecting pin guide portion 232 and 282.

A limiting ring 270 for limiting movement of the shift lever 220 is formed to the control shaft 203.

A camshaft guide slot 205 is formed to the camshaft 201 for the cam connecting pin 250 movable along length direction of the camshaft 201.

A camshaft spline 207 and a cam spline (referring to FIG. 2) is respectively formed to the camshaft 201 and the cam 210, and thus, the camshaft 201 and the cam 210 are splined for the cam 210 movable to length direction of the control shaft 203.

Hereinafter, referring to FIG. 7 to FIG. 11, operations of the variable valve lift apparatus according to the second exemplary embodiment of the present invention will be explained.

Low lift mode of the variable valve lift apparatus according to the second exemplary embodiment of the present invention is shown in FIG. 7.

In the low lift mode, the control pin 240 rotates along the low lift path 224 of the shift lever 220 and the low lift cam lobe 214 of the cam 210 contacts the valve opening/closing unit 300 and opens and closes the valve opening/closing unit 300.

If changing of mode from low lift mode to high lift mode is required according to engine operation condition, an ECU (engine control unit, not shown) operates an actuator, a step motor and so on, for the control shaft 203 to move to left direction of the drawing.

And then, the control ring 250 connected to the control shaft 203 moves toward left direction of the drawing with the control shaft 203.

Also, the shift lever 220 is moved toward left direction of the drawing by elastic force of the elastic member 260 contacting the control ring 250.

In the shift lever 220, the control pin 240 passes through the connecting penetration 228 and rotates along the high lift path 222.

And then, the cam connecting pin 252 moves toward left direction of the drawing, and also the cam 210 moves toward left direction to the camshaft 201.

And thus, the valve opening/closing unit 300 contacts to the high lift cam lobe 212 and is opened and closed.

If changing of mode from the high lift mode to the low lift mode is required according to engine operation condition, the control shaft 203 to move to right direction of the drawing, and the control ring 250 connected to the control shaft 203 moves toward right direction of the drawing with the control shaft 203.

Also, the shift lever 220 is moved toward right direction of the drawing by elastic force of the elastic member 260 and the control pin 240 passes through the connecting penetration 228 and rotates along the low lift path 224.

And then, the cam connecting pin 252 moves toward right direction of the drawing, and also the cam 210 moves toward right direction to the camshaft 201.

And thus, the valve opening/closing unit 300 contacts to the low lift cam lobe 214 and is opened and closed.

In the FIG. 8, while the elastic portions 260 as a pair are disposed both side of the shift lever 220, it is not limited to the drawing. One, elastic member may be provided for supplying compress/expansion elastic force.

In the first and second exemplary embodiments of the present invention, while only high and low operation modes of the variable valve lift apparatus has been described, however, it is not limited to the disclosed embodiments. If the low lift lobe is a base circle, CDA (cylinder deactivation) mode may be realized.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

a control shaft slidably disposed within a camshaft;

a cam which is slidably disposed to the camshaft and a high lift cam lobe and a low lift cam lobe are formed thereto;

a valve opening/closing unit slidably contacting the cam; and a control portion which moves the cam for the high lift cam lobe or the low lift cam lobe selectively to contact the valve opening/closing unit according to operation of the control shaft;

wherein the control portion comprises:

a shift lever which is slidably mounted to the control shaft, wherein a high lift path and a low lift path are formed along an outer surface of the shift lever, and a partition is formed therebetween; and a control pin which protrudes from an inner surface of the camshaft, and selectively rotates along the high lift path and the low lift path, wherein a connecting penetration is formed to the partition for the control pin to be movable between the high lift path and the low lift path.

2. The apparatus of claim 1, wherein the control portion further comprises:

a control ring fixed to the control shaft;

a rotation ring which is slidably and rotatably mounted to the control shaft and rotates with the camshaft, wherein a cam connecting pin connects the cam with the rotation ring; and an elastic member disposed between the control ring and the rotation ring.

3. The apparatus of claim 1, wherein the control portion comprises:

a control ring fixed to the control shaft;

a shift lever slidably mounted to the control shaft, wherein a high lift path and a low lift path are formed thereto and divided by a partition therebewteen and a connecting penetration is formed to the partition, wherein the shift lever is movable in a length direction of the control shaft according to movement of the control ring;

a control pin which protrudes from an inner surface of the camshaft, and selectively rotates along the high lift path and the low lift path according to movement of the shift lever;

a rotation ring which is slidably and rotatably mounted to the control shaft, wherein a cam connecting pin connects the cam and the rotating ring such that the rotation ring rotates with the camshaft; and an elastic member disposed between the control ring and the rotation ring.

4. The apparatus of claim 1, wherein:

the rotation ring is disposed to an end of the shift lever;

the control ring is disposed as a pair, and the shift lever and the rotation ring is disposed between the control ring; and the elastic member is disposed between the rotation ring and the control ring.

5. The apparatus of claim 2, wherein a camshaft guide slot is formed to the camshaft and receives the cam connecting pin therein for the cam connecting pin to be movable in the length direction of the camshaft.

6. The apparatus of claim 2, wherein the control portion further comprises an elastic member supporting ring disposed between the elastic member and the rotation ring.

7. The apparatus of claim 2, wherein the camshaft and the cam are splined for the cam to be movable in the length direction of the control shaft.

8. The apparatus of claim 1, wherein the control portion comprises:

a shift lever which is slidably mounted to the control shaft, wherein a high lift path and a low lift path are formed to the shift lever and divided by a partition therebetween and a connecting penetration is formed to the partition, wherein a shift lever guide slot is formed to the shift lever in a length direction thereof, and wherein a cam connecting pin guide portion is formed along an outer circumference of the shift lever;

a control pin which protrudes from an inner surface of the camshaft, and selectively rotates along the high lift path and the low lift path;

a control ring which is disposed to the shift lever and slidable within a predetermined distance, and connected to the control shaft through the shift lever guide slot; and a cam connecting pin connected to the cam and rotating along the cam connecting pin guide portion, wherein the shift lever is movable in the length direction of the control shaft by movement of the control ring.

9. The apparatus of claim 8, wherein:

a plurality of cam connecting pin guide portion is formed to the shift lever;

the control ring is disposed between the cam connecting pin guide portions; and an elastic member is disposed between the control ring and the cam connecting pin guide portion.

10. The apparatus of claim 8, wherein the variable valve lift apparatus further comprises an end ring which is disposed at an end of the shift lever, and a cam connecting pin guide portion is formed thereto, wherein the control ring is disposed between cam connecting pin guide portions formed to the end ring and the shift lever, and an elastic member is disposed between the each cam connecting pin guide portion and the control ring.

11. The apparatus of claim 8, wherein a limiting ring for limiting movement of the shift lever is formed to the control shaft near to the shift lever.

12. The apparatus of claim 8, wherein a camshaft guide slot is formed to the camshaft to receive the cam connecting pin for the cam connecting pin to be movable in the length direction of the camshaft.

13. The apparatus of claim 8, wherein the camshaft and the cam are splined for the cam to be movable in the length direction of the control shaft.

* * * * *